US008898973B2

(12) United States Patent
Miller

(10) Patent No.: US 8,898,973 B2
(45) Date of Patent: Dec. 2, 2014

(54) BUILDING CAVITY VENTILATION SYSTEM

(71) Applicant: Solar Innovations, Inc., Pine Grove, PA (US)

(72) Inventor: Gregory E. Miller, Pine Grove, PA (US)

(73) Assignee: Solar Innovations, Inc., Pine Grove, PA (US)

( * ) Notice: Subject to any disclaimer, the term of this patent is extended or adjusted under 35 U.S.C. 154(b) by 0 days.

(21) Appl. No.: 13/776,106

(22) Filed: Feb. 25, 2013

(65) Prior Publication Data

US 2014/0237918 A1 Aug. 28, 2014

(51) Int. Cl.
*E06B 7/02* (2006.01)
*E06B 3/667* (2006.01)
*E06B 3/677* (2006.01)

(52) U.S. Cl.
CPC . *E06B 7/02* (2013.01); *E06B 3/677* (2013.01); *E06B 2007/026* (2013.01)
USPC ..... 52/209; 52/302.3

(58) Field of Classification Search
USPC ..... 52/209, 204.52, 204.5, 302.1, 302.3, 52/302.6, 220.8; 359/258, 265; 454/70–74, 195, 196, 211, 213, 340
See application file for complete search history.

(56) References Cited

U.S. PATENT DOCUMENTS

| | | | | |
|---|---|---|---|---|
| 3,410,027 | A | 11/1968 | Bates | |
| 3,636,660 | A * | 1/1972 | Peterson | 49/408 |
| 4,656,803 | A * | 4/1987 | Chludil | 52/209 |
| 5,044,121 | A * | 9/1991 | Harbom et al. | 49/401 |
| 7,574,829 | B1 * | 8/2009 | Prager | 49/408 |
| 7,650,721 | B2 * | 1/2010 | Nevins | 52/173.3 |
| 8,033,056 | B2 * | 10/2011 | Wernlund et al. | 49/408 |
| 2008/0092456 | A1 * | 4/2008 | Millett et al. | 52/1 |

* cited by examiner

*Primary Examiner* — William Gilbert
*Assistant Examiner* — Kyle Walraed-Sullivan
(74) *Attorney, Agent, or Firm* — Shlesinger, Arkwright & Garvey LLP

(57) ABSTRACT

A system for ventilating the cavity of a fixed or movable window or door construction of a building, the window or door having an upper sill or header and a low sill provided with weep holes and a pair of jamb elements, the system comprising a vent member operative associated with the upper sill portion, the vent member is in fluid communication with the upper sill at one end thereof and also with the interior of the building at an opposite end thereof, the vent member extends vertically above the upper sill a distance sufficient to vent pressure within the cavity to the interior of the building so that water is caused to be readily conveyed out of the weep holes regardless of any pressure differential between the interior and exterior of the building.

15 Claims, 4 Drawing Sheets

BUILDING CAVITY VENTILATION SYSTEM

FIELD OF THE INVENTION

This invention relates to window, door and wall constructions and in particular, a system for ventilating and draining rainwater from such constructions.

BACKGROUND OF THE INVENTION

A common problem associated with window and door constructions is the accumulation of water with the sill structure during storm conditions. Water will collect on the inside of the sill plate due to leakage around or under the movable sash or because the sash did not properly seal against the sill and vertical frame members.

Prior art efforts to mitigate the accumulation of water include providing a series of vents with flaps on an exterior face of the top sill or head of the window. This permits outside air pressure to enter the head. A series of weep or drainage holes are provided in the bottom sill to allow entrapped water to be forced out of the sill under pressure from the vent.

While the above system performs reasonably well at lower pressures, it becomes increasingly difficult to drain entrapped water at higher pressures, namely during storm conditions. For optimal drainage a window, door or wall frame would preferably vent to a neutral pressure. However, when the prior art system is subjected to the relatively high pressures such as those encountered during windy and rainy weather, the cavity inside the window or door sill is at that same pressure and draining becomes difficult if not impossible. This is best shown in FIG. 5 of the drawings which illustrates the prior art pressure imbalance and resultant accumulation of water within the sill. In view of the fact that storm conditions involve large amounts of water; a need has existed in the art for a building cavity ventilation system that functions under varying conditions including those involving high exterior pressures. Further, the vents provided in the top sill of the prior art window or doors are predisposed to allow entry of excess water into sill which undesirably increases the quantity of water that needs to be drained.

BRIEF SUMMARY OF THE INVENTION

The present invention is a system for ventilating the cavity of a fixed or movable window or door construction of a building, the window or door having an upper sill portion and a low sill portion provided with weep holes, the system comprising a vent member operative associated with the upper sill portion, the vent member is in fluid communication with the upper sill portion at one end thereof and with the interior of the building at an opposite end thereof, the vent member extends vertically above the upper sill a distance sufficient to vent pressure within the cavity to the interior of the building whereby water is caused to be readily conveyed out of the weep holes.

DETAILED DESCRIPTION OF THE INVENTION

Figure 1:
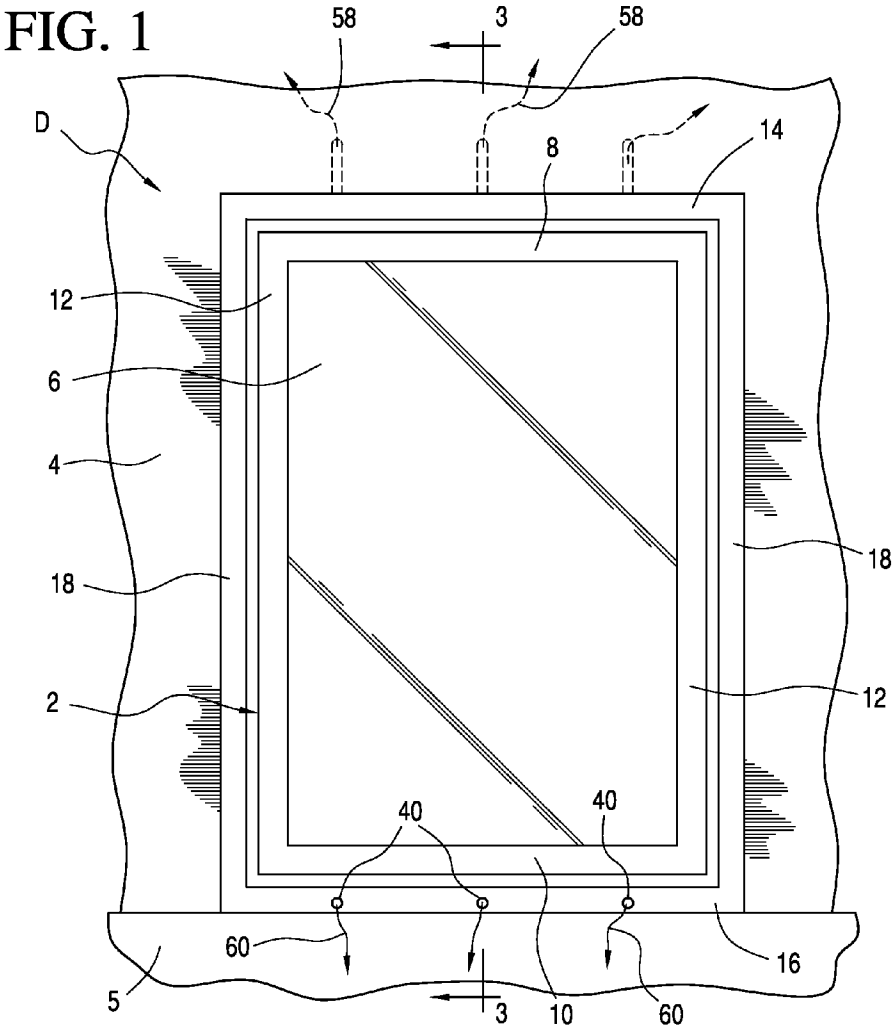
FIG. 1 is a perspective elevational view of a door or window construction embodying the present invention and viewed from the exterior of the building to which it is installed.

A door construction D incorporating the ventilation system of the present invention is shown in FIG. 1. As is apparent, the present invention is adapted for use in connection with any wall construction exposed to outside weather conditions including, but not limited to, windows, glazed walls, curtain walls and similar structures adapted to movably opened or remain fixedly closed.

Figure 3:
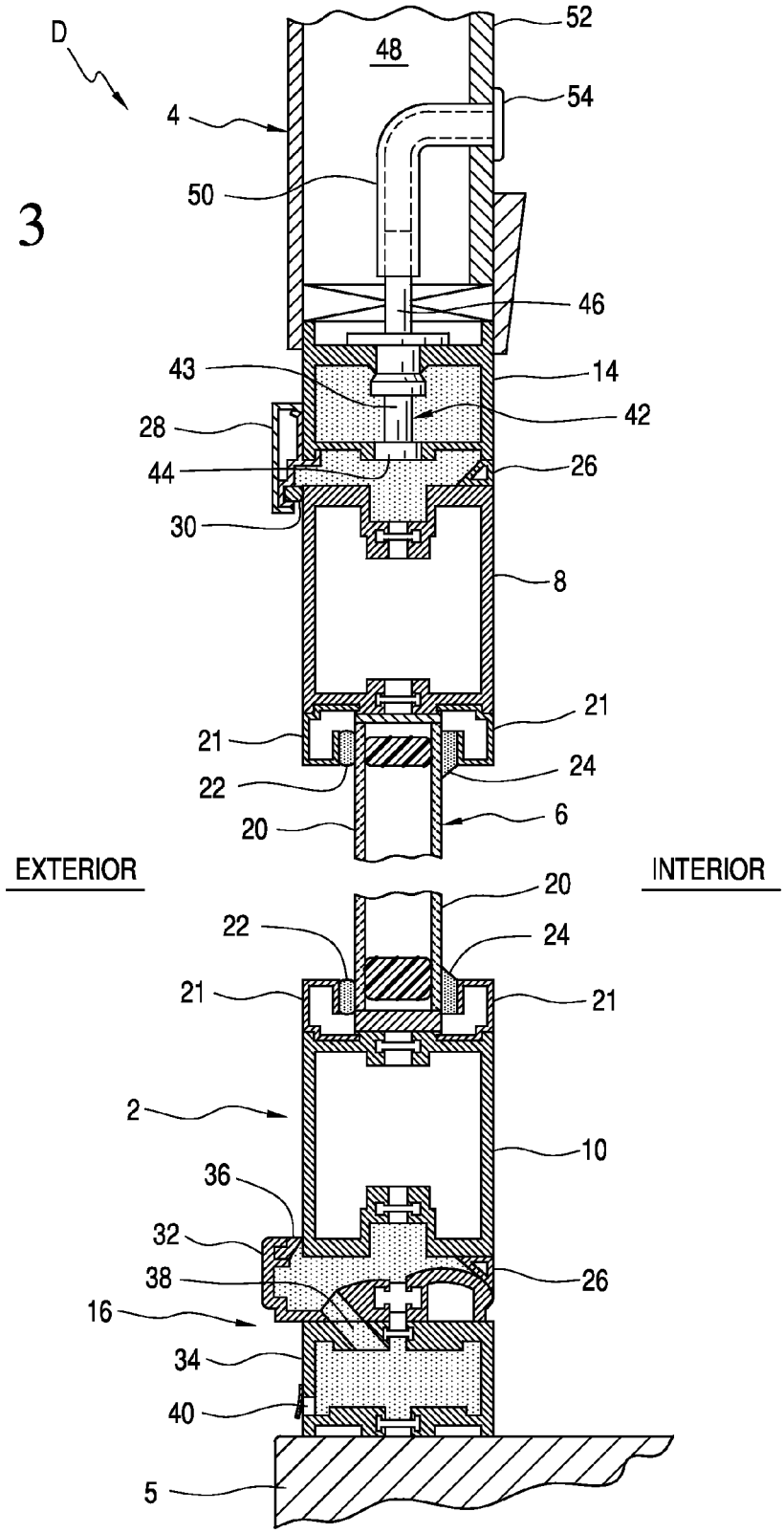
FIG. 3 is an enlarged sectional view taken along lines 3-3 of FIG. 1.

As best shown in FIGS. 1 and 3, door construction D includes a substantially rectangular frame 2 provided within wall structure 4 and that is adjacent a floor substrate 5 in the known manner. The door frame 2 includes a glazing 6 comprising double pane glass. The frame 2 further comprises a top frame portion 8, bottom frame portion 10 and side frame portions 12. The door frame is hingedly associated with (not shown) and in sealed engagement with a door head 14, door sill 16 and side members 18 in the known manner.

Turning to FIG. 3, a first embodiment of the present invention is shown in greater detail. The interior of the door frame 2 is shown to be hollow or otherwise open and in fluid communication with the door head 14 and sill 16. Glazing 6 comprises a pair of glass panes 20 fixed to and in sealed engagement with door frame 2. A series of glass stops 21 secure the glass panes 20 to the frame. Gaskets 22 are provided for the exterior facing glass surface and second pair of gaskets 24 is provided for the interior facing glass services and in the known manner. As is apparent, various other glazing options including, but not limited to, polycarbonate, acrylic sheets, solid panels and the like are within the scope of the present invention.

Interior door sill gasket(s) 26 provides sealing engagement between the door frame 2 and the door head, 14, sill 16 and side members 18 (not shown). A door cap 28 and gasket 30 are fixed to the exterior of the door head 14 and provide sealing engagement against the door frame 2.

The door sill 16 is shown to comprise an upper sill portion 32 and lower sill portion 34. The upper sill portion 16 is provided with a door gasket 36 for sealing engagement with bottom frame portion 10. A passageway extending between the upper sill portion 32 and the lower sill portion 34 permit any entrapped water to be expelled from the sill and to the outside via a series of weep holes 40.

Door head 14 is fitted with a vent tube 42 having a first end 43 secured to and in fluid communication with the head opening 44. A second end 46 of the vent tube 42 extends into the interior space 48 of the wall structure 4. A vent tube extension 50 is shown to be connected to the second end 46 of the vent tube to extend the length of the same as desired and will terminate at interior wall 52. A vent cover 54 is provided together with an optional one way valve (not shown) incorporated within or otherwise secured to the interior of vent tube 50. The valve would additionally function to reduce heat loss from the interior of the building during cold weather months.

The vent tube 42 (alone or in combination with the extension 50) has a length or height extending above the door head that will depend upon the performance goals of the window or door to which the ventilation system is provided. The height of the tube vent above the door head is varied in accordance with the present invention to ensure no moisture enters the interior of the window structure or the building. By providing a vent tube that extends vertically above the door or window head 14, a pressure level can be achieved that will efficiently maintain the water column below the vent so that water can readily exit from the weep holes 40.

Figure 2:
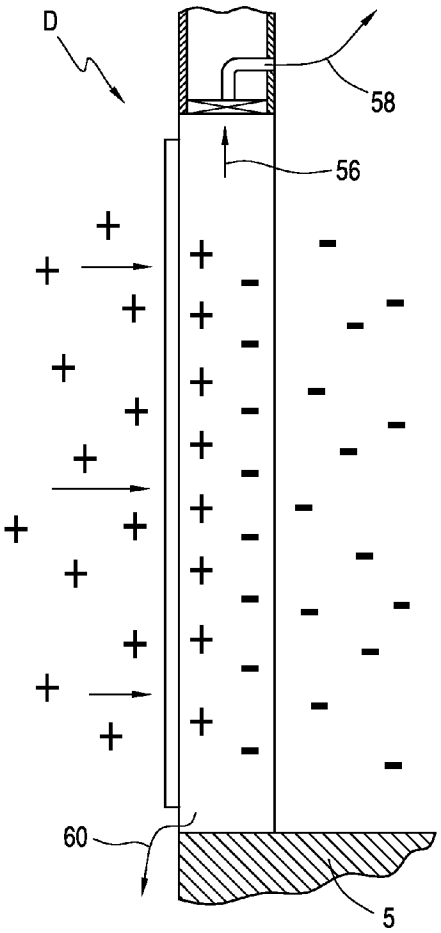
FIG. 2 is a schematic side sectional view of FIG. 1 illustrating the relative air pressures on the interior and exterior faces of the door or window construction.

With the present invention, outside air pressure cannot affect interior cavity pressure of the door or window so as to hinder water flow from the weep holes. As best illustrated by the lightly shaded regions of FIG. 3, the interior cavities of the door head 14 and door sill 16 are vented to release or otherwise neutralize pressure within the cavities to allow water to readily exit the weep holes in the sill. FIG. 2 schematically illustrates the pressure within the aforementioned door cavities being continuously vented (arrows 56 and 58) to the interior of the building or structure and above the door to provide a neutral pressure within the cavities that permit any accumulated water to be readily drained from the weep holes in the sill (arrow 60).

Figure 4:
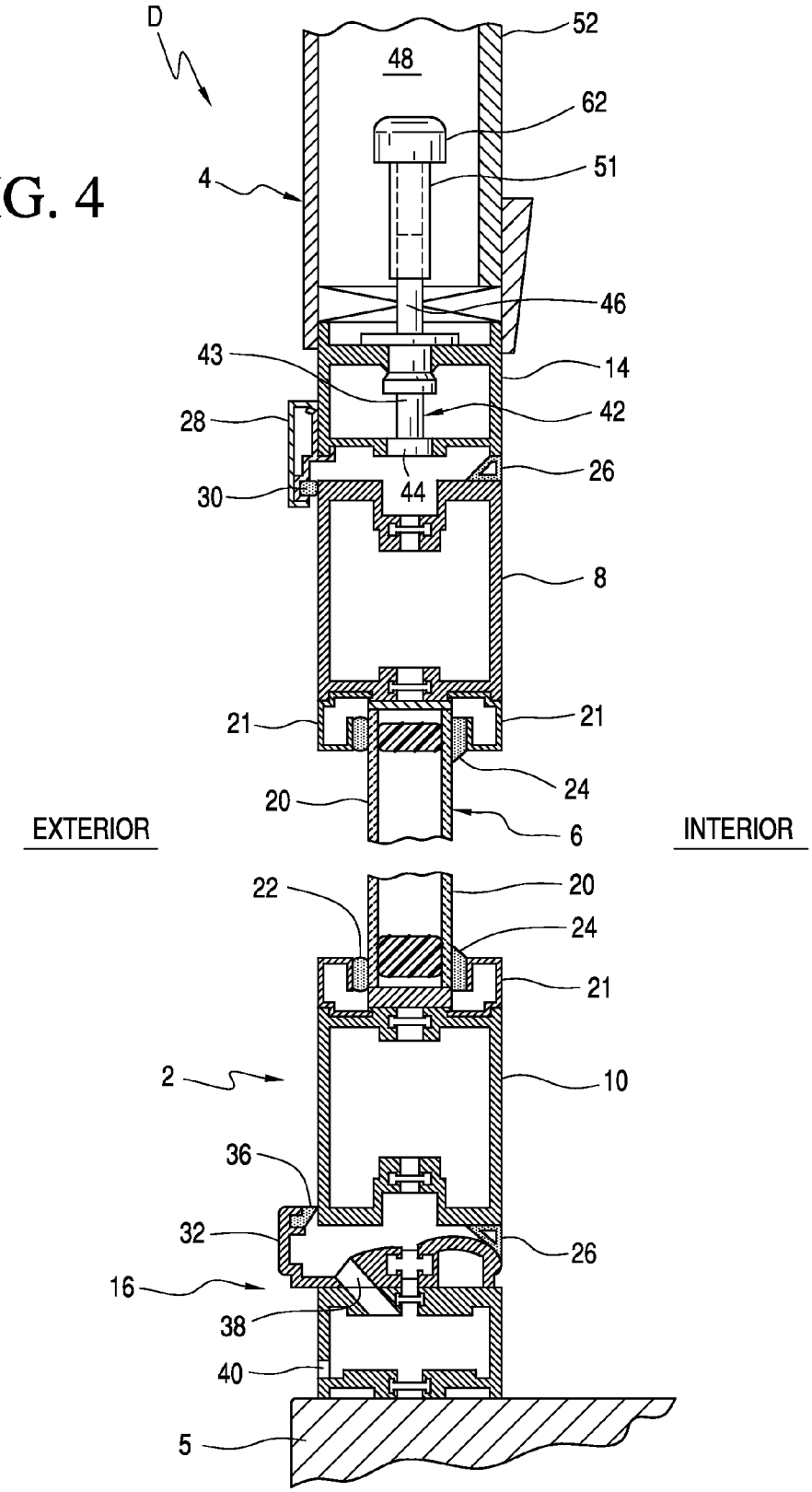
FIG. 4 illustrates an alternative embodiment of the invention shown in FIG. 3.
Figure 5:
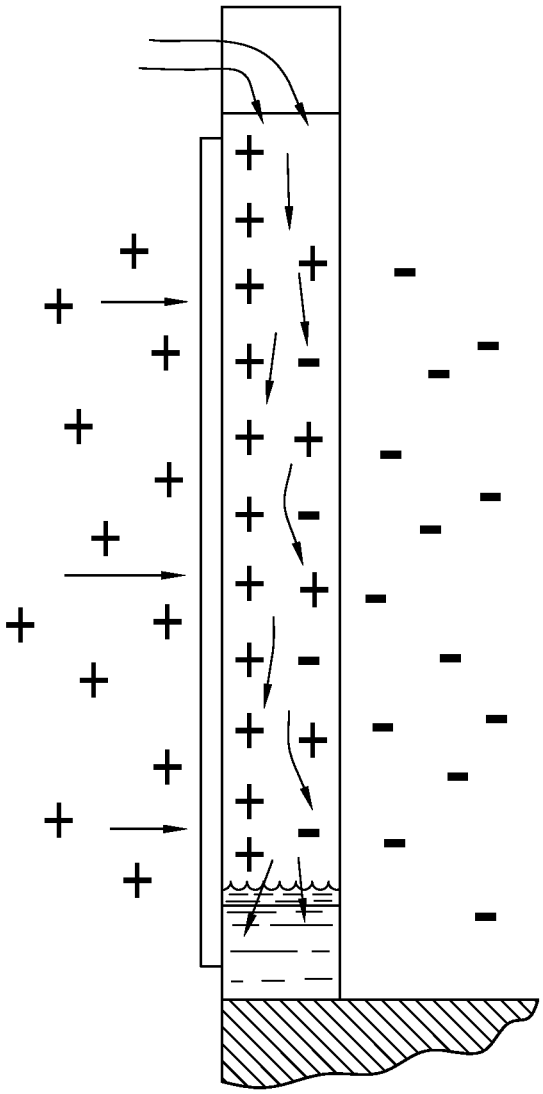
FIG. 5 (Prior Art)
FIG. 5 is a schematic sectional side view of the prior art.

FIG. 4 illustrates an alternative embodiment of the present invention. All reference numerals in this figure are similar to the previous embodiment except for the following. In this embodiment, a vent tube extension 51 terminates at a breather cap 62 within the interior space 48 of wall structure 4. Also, breather cap 62 could be installed with a ball valve, or flap in some situations to increase performance. This may be practical to improve air performance and water performance simultaneously. Terminating the vertically extending vent tube within the interior of the building wall cavity provides an effective air seal and reduces loss of heat from the interior of the building which is advantageous during cold weather months.

As discussed earlier, the height of the vent tube (with or without the extension) is varied to improve weep performance of a window or door construction. The vertical height of the vent tube 42 above the door or window head 14 corresponds to the goal pressures being sought due to water column height. For example, a door or window construction that is desired to withstand a water pressure of 6.24 psf will require a vent tube according to the present invention (either with or without the extension) having a length greater than 1.2 inches since water pressurized to 6.24 psf will rise 1.2 inches. For comparison purposes, if the door or window goal is 20.22 psf, to prevent water infiltration to the interior of the building and water building within the window or door, the vertical height of the vent tube above the door or window head would be 3.88 inches.

Performance testing using ASTM protocols for a door construction of the present invention has shown the present invention provides more than a twofold improvement in water test pressures over a identical door construction that was not provided with the ventilation system of the present invention.

In the testing, applicant's In-Swing Terrace Door with Tank was tested for water penetration. In a first test the In-Swing Terrace Door having no head vent tubes but having head weeps open was tested for water penetration against an In-Swing Terrace Door having head vent tubes with the head weeps closed off. Test method ASTM E331 was conducted on these two systems for purposes of measuring water penetration.

A water test pressure of 15.0 psf (lbs./sq. ft.) was achieved for the In-Swing Terrace Door having head vent tubes with the head weeps closed off. A water test pressure of 6.0 psf was achieved for the In-Swing Terrace Door having no head vent tubes and with the head weeps open.

While this invention has been described as having a preferred design, it is understood that it is capable of further modifications, uses and adaptations, both in whole and in part, while following the general principle of the invention and including such departures from the present disclosure as is known or customary practice in the art to which this invention pertains, and as may be applied to the central features of this invention.

I claim:

1. A venting system for a cavity comprising:

(a) a window, door or wall construction supporting at least one pair of glazed panels, the window, door or wall construction further comprising:

a header, jamb members, and a lower sill, said lower sill having weep holes, each of the header, jamb members and lower sill have a hollow construction that cooperate to form a cavity;

(b) a vent member, the vent member including a conduit having a first end and a second end, the first end is connected to and is in fluid communication with the cavity and is spaced from the at least one pair of glazed panels and faces a top edge of the at least one pair of glazed panels when in an installed position, the second end is connected to the interior of a building and is spaced from the at least one pair of glazed panels when in an installed position, the conduit extends vertically above the header and at a height sufficient to enable pressure in the cavity to be vented to the interior of the building so as to substantially equalize pressures in the cavity with that of the building whereby water collecting in the cavity is conveyed from the weep holes regardless of exterior pressure against the window.

2. A venting system as in claim 1 and further comprising at least one of a vent cover, one-way valve, breather cap and ball valve is secured to the second end of the conduit.

3. A venting system as in claim 1 and wherein the conduit is a vent tube combined with a vent tube extension.

4. A venting system as in claim 3 and wherein the vent tube extension extends inside a surrounding wall structure to which the window, door or wall construction is secured.

5. A venting system as in claim 3 and wherein the vent tube extends inside a surrounding wall structure to which the window, door or wall construction is secured and terminates outside of the surrounding wall structure.

6. The venting system as in claim 1 and wherein the header, the jamb members and the lower sill are operatively associated with a door or window frame and sealingly engage thereagainst and a gap region is formed between the frame and the header, jamb members and lower sill, the gap region is in fluid communication with the cavity.

7. A window, door or wall construction comprising:

a) a window or door frame containing at least one pane of glass or plastic;

b) a header;

c) jamb members;

d) a lower sill having weep holes, the header, jamb members and lower sill having a hollow construction that provide a continuous cavity;

e) a vent member, the vent member including a conduit having a first end and a second end, the first end is connected to and is in fluid communication with the cavity and is spaced from the at least one pane and faces a top edge of the at least one pane when in an installed position, the second end is connected to the interior of a building and is spaced from the at least one pane when in an installed position, the conduit extends vertically above the header and at a height sufficient to enable pressure in the cavity to be vented to the interior of the building so as to substantially equalize pressure in the cavity to that within the building whereby water collecting in the cavity is conveyed from the weep holes regardless of exterior pressure against the window.

8. A window, door or wall construction as in claim 7 and further comprising at least one of a vent cover, one-way valve, breather cap and ball valve is secured to the second end of the conduit.

9. A window, door or wall construction as in claim 7 and wherein the conduit is a vent tube combined with a vent tube extension.

10. A window, door or wall construction as in claim 9 and wherein the vent tube extension extends inside a surrounding wall structure to which the window, door or wall construction is secured.

11. A window, door or wall construction as in claim 9 and wherein the vent tube extends inside a surrounding wall structure to which the window, door or wall construction is secured and terminates outside of the surrounding wall structure.

12. A window, door or wall construction as in claim 7 and wherein the header, the jamb members and the lower sill are operatively associated with the door or window frame and sealingly engage thereagainst and a gap region is formed between the frame and the header, jamb members and lower sill, the gap region is in fluid communication with the cavity.

13. A venting system as in claim 1 and wherein the window, door or wall construction is at least one of a curtain wall or a glazed wall.

14. A window, door or wall construction as in claim 7 and wherein the window, door or wall construction is at least one of a curtain wall or a glazed wall.

15. A window, door or wall construction as in claim 7 and wherein the at least one pane of glass or plastic is a cooperating pair of glazed panes.

* * * * *